US007770329B2

(12) United States Patent
Hutnik et al.

(10) Patent No.: US 7,770,329 B2
(45) Date of Patent: Aug. 10, 2010

(54) DOOR ROLLER SYSTEM

(75) Inventors: Steve Peter Hutnik, Plymouth, MI (US); Steven Michael Gwozdek, Tecumseh, MI (US); Nirav Raj D. Parikh, Taylor, MI (US); John Tremble, Redmond, WA (US)

(73) Assignee: Milgard Manufacturing Incorporated, Tacoma, WA (US)

( * ) Notice: Subject to any disclaimer, the term of this patent is extended or adjusted under 35 U.S.C. 154(b) by 501 days.

(21) Appl. No.: 11/180,419

(22) Filed: Jul. 13, 2005

(65) Prior Publication Data

US 2007/0017065 A1 Jan. 25, 2007

(51) Int. Cl.
*E05D 13/00* (2006.01)

(52) U.S. Cl. ..... 49/425; 49/410; 49/411

(58) Field of Classification Search ..... 49/425, 49/410, 411; 16/105
See application file for complete search history.

(56) References Cited

U.S. PATENT DOCUMENTS

| | | | | | |
|---|---|---|---|---|---|
| 95,350 | A | * | 9/1869 | Hugunin | 49/425 |
| 2,505,592 | A | | 4/1950 | Stone | |
| 2,525,971 | A | | 10/1950 | Stone | |
| 2,668,318 | A | | 2/1954 | Le Bon, III | |
| 3,040,391 | A | * | 6/1962 | Saunders | 49/425 |
| 3,097,401 | A | | 7/1963 | Riegelman | |
| 3,167,112 | A | * | 1/1965 | Tucker | 49/425 |
| 3,208,109 | A | * | 9/1965 | Buck, Jr. | 49/425 |
| 3,237,238 | A | * | 3/1966 | Anderson | 16/105 |
| 3,443,340 | A | | 5/1969 | Helmick et al. | |
| 3,693,293 | A | * | 9/1972 | Egan et al. | 49/56 |
| 3,698,036 | A | | 10/1972 | Goodman | |
| 3,716,890 | A | | 2/1973 | Benson | |
| 3,750,337 | A | * | 8/1973 | Brydolf et al. | 49/411 |
| 3,959,849 | A | | 6/1976 | Marquardt | |
| 3,996,643 | A | * | 12/1976 | Steigerwald | 16/99 |
| 4,014,073 | A | | 3/1977 | Uehara | |
| 4,064,593 | A | | 12/1977 | Helmick | |
| 4,078,335 | A | * | 3/1978 | Uehara | 49/425 |
| 4,123,874 | A | * | 11/1978 | Scott | 49/411 |
| 4,194,266 | A | | 3/1980 | Natzel | |
| 4,262,451 | A | * | 4/1981 | Dallaire | 49/425 |
| 4,282,631 | A | | 8/1981 | Uehara et al. | |

(Continued)

FOREIGN PATENT DOCUMENTS

EP 1 522 666 A1 4/2005

(Continued)

OTHER PUBLICATIONS

International Search Report for PCT/US2006/026693, date of mailing, Dec. 22, 2006, 3 pages.

*Primary Examiner*—Katherine W Mitchell
*Assistant Examiner*—Catherine A Kelly
(74) *Attorney, Agent, or Firm*—Foley & Lardner LLP

(57) ABSTRACT

A door roller system is disclosed. The door roller system comprises a first housing including at least one generally vertical side member having at least one slot; a base slidably coupled to the first housing and having at least one projection that extends at least partially through the slot; and at least one wheel coupled to the base. The projection on the base is configured to slide within the slot on the first housing as the base is moved relative to the first housing.

16 Claims, 6 Drawing Sheets

U.S. PATENT DOCUMENTS

| | | | | | |
|---|---|---|---|---|---|
| 4,404,771 | A | * | 9/1983 | Murase et al. | 49/425 |
| 4,633,615 | A | | 1/1987 | Moose | |
| 4,850,145 | A | * | 7/1989 | McAfee | 49/501 |
| 4,912,807 | A | | 4/1990 | Futch et al. | |
| 4,912,878 | A | * | 4/1990 | Bentley | 49/379 |
| 5,671,502 | A | * | 9/1997 | Ezman | 16/105 |
| 5,673,516 | A | * | 10/1997 | Hughes et al. | 49/425 |
| 5,791,089 | A | * | 8/1998 | Prevot et al. | 49/425 |
| 5,845,363 | A | | 12/1998 | Brempell et al. | |
| 5,927,017 | A | * | 7/1999 | Jacobs et al. | 49/410 |
| 5,950,279 | A | | 9/1999 | Chaput | |
| 5,964,061 | A | * | 10/1999 | Hughes et al. | 49/425 |
| 6,021,547 | A | * | 2/2000 | Stagoll | 16/105 |
| 6,142,082 | A | * | 11/2000 | Burke et al. | 105/377.09 |
| 6,526,625 | B2 | * | 3/2003 | Becken | 16/105 |
| 6,681,445 | B2 | | 1/2004 | Huang | |
| 6,698,138 | B1 | * | 3/2004 | Lin | 49/409 |
| 6,813,862 | B2 | * | 11/2004 | Perich et al. | 49/425 |
| 7,021,007 | B2 | * | 4/2006 | Jacobs | 49/425 |
| 7,293,389 | B2 | * | 11/2007 | Jacobs | 49/425 |
| 2001/0054258 | A1 | | 12/2001 | Becken | |
| 2005/0011041 | A1 | * | 1/2005 | Ness | 16/105 |
| 2005/0246962 | A1 | * | 11/2005 | Jacobs | 49/425 |
| 2005/0284028 | A1 | * | 12/2005 | Gerhart | 49/425 |
| 2007/0017157 | A1 | * | 1/2007 | Ambrozus | 49/425 |

FOREIGN PATENT DOCUMENTS

| | | |
|---|---|---|
| JP | 10-227170 | 8/1998 |

* cited by examiner

FIG. 9
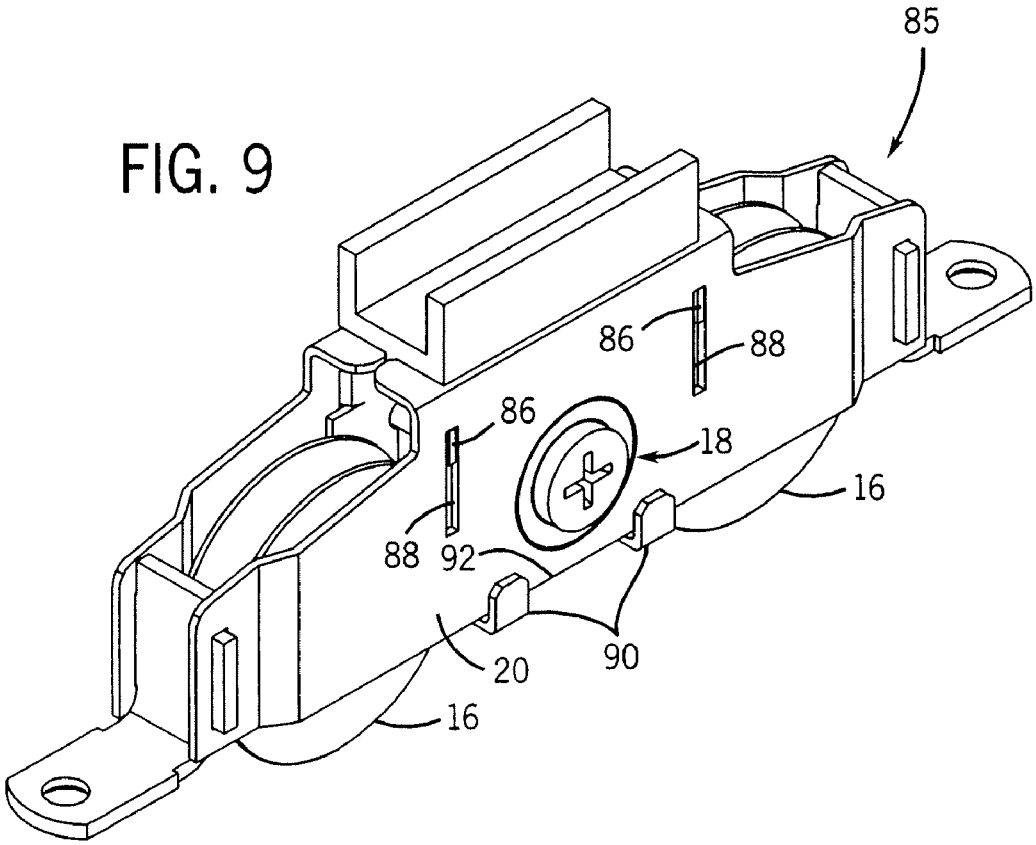
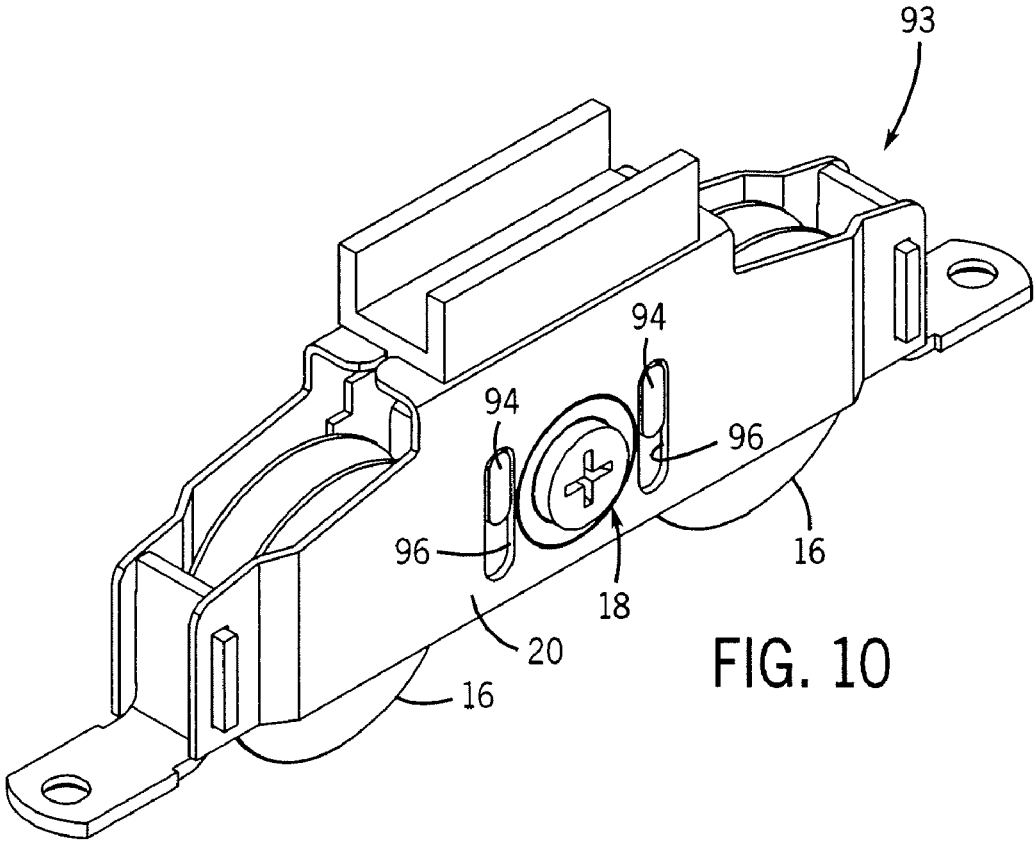
FIG. 10

DOOR ROLLER SYSTEM

CROSS-REFERENCE TO RELATED PATENT APPLICATIONS

None.

FIELD OF THE INVENTION

The present invention relates to a door roller system. More specifically, the present invention relates to a door roller system having an outer housing, an inner housing, and features for allowing adjustment of the inner housing within the outer housing.

BACKGROUND

It is generally known to provide for a door roller system for sliding of doors such as patio doors. Such door roller systems typically include a base or housing for supporting the door and one or more wheels or rollers coupled to the housing. Typically, known door roller systems are adjustable to permit adjustment to the height or spacing of the housing relative to the wheels. Some known systems also purport to have self leveling roller wheels to prevent the system from rocking or falling out of level orientation when in the full up wheel position.

However, such known door roller systems have several disadvantages. For example, known systems typically do not inhibit the inner housing and wheel assembly from rocking or rotating relative to the housing. Known systems that purport to inhibit rotation only do so when the wheels are in the full up wheel position using tabs that become inserted in slots located on an upper portion of the housing that has been curved inward. The top most position in such known systems is susceptible to inconsistent performance due to fabrication and engagement of these tabs and slots.

Accordingly, it would be advantageous to provide a door roller system with features for allowing adjustment of the inner housing within the outer housing. It would also be advantageous to provide an inner housing that slides within the outer housing with minimal rocking or rotating throughout its range of movement. It would further be advantageous to provide tabs on the lower portion of the inner housing that engage the lower portion of the outer housing. It would further be advantageous to provide slots in the outer housing to guide projecting surfaces of the inner housing to prevent rocking. It would further be advantageous to provide projections on an internal, wedge adjusting element that extend through the inner housing sidewalls and slide within slots on the outer housing. It would be desirable to provide for a door roller system having one or more of these or other advantageous features. To provide an inexpensive, easy to manufacture, reliable, and widely adaptable door roller system that avoids the above-referenced and other problems would represent a significant advance in the art.

SUMMARY

The present invention relates to a door roller system. The door roller system comprises a first housing including at least one generally vertical side member having at least one slot. A base is slidably coupled to the first housing and has at least one projection that extends at least partially through the slot. At least one wheel is coupled to the base. The projection on the base is configured to slide within the slot on the first housing as the base is moved relative to the first housing.

In another embodiment, the door roller system comprises an outer housing and an inner housing movable relative to the outer housing between a first position and a second position. The inner housing has at least one tab that is configured to engage the outer housing when the inner housing is in the second position.

In a further embodiment, the door roller system comprises a first housing, a second housing, and at least one wheel. The first housing has at least one generally vertical slot. The second housing is slidably coupled to the first housing and includes at least one generally vertical side member and a base having at least one projection. The wheel is rotatably coupled to the second housing. The projection extends through the side member and is configured to slide within the slot throughout the range of movement of the second housing between a first position and a second position.

The present invention further relates to various features and combinations of features shown and described in the disclosed embodiments.

DESCRIPTION OF THE FIGURES

FIG. 9 is a perspective view of a door roller system according to yet another exemplary embodiment.

FIG. 10 is a perspective view of a door roller system according to yet another exemplary embodiment.

DETAILED DESCRIPTION OF PREFERRED AND OTHER EXEMPLARY EMBODIMENTS

Figure 1:
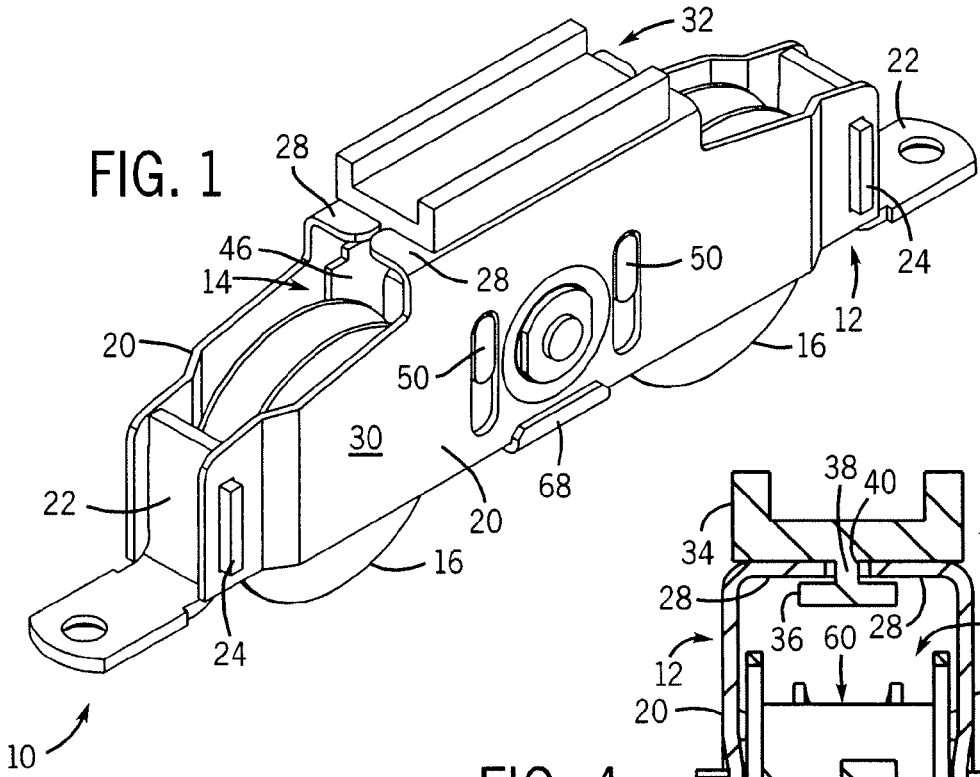
FIG. 1 is a perspective view of a door roller system according to a preferred embodiment.
Figure 4:
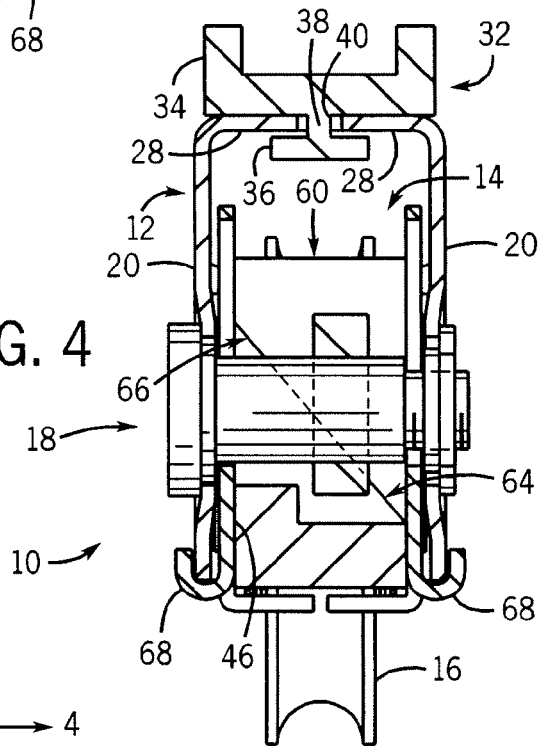
FIG. 4 is a sectional view of the door roller system of FIG. 3 taken along line 4-4.

FIGS. 1-4 show a door roller system 10 according to a preferred embodiment. Door roller system 10 is configured to allow or assist in moving a panel such as a door along, for example, a pathway such as a track or rail. Door rail system 10 is adjustable to allow changes to be made to the height of the panel being supported. Door roller system 10 includes an outer housing 12, an inner housing 14, rollers 16, and an adjustment mechanism 18.

Outer housing 12 includes a pair of generally vertical side members 20 connected by end members 22. End members 22 include tabs 24 that extend into slots 26 on side members 20. Each side member 20 includes a bent flange 28 that extends generally perpendicular to the major surface 30 of side members 20. A spacer 32 may be coupled to outer housing 12. Spacer 32 includes an upper portion 34 and a lower portion 36 connected to upper portion 34 by a web 38. Web 38 is captured in a slot 40 formed by recesses 42 on opposing flanges 28 extending perpendicular from major surfaces 30 of outer housing side members 20.

Inner housing 14 is adjustable within outer housing 12 by adjustment mechanism 18. Such adjustment changes the height of the door supported by door rail system 10. Inner housing 14 includes a pair of generally vertical side members 46 that are coupled to each other by a base 48, which is further described below with respect to adjustment mechanism 18. Base 48 is coupled to side members by elongated projections shown as projections 50 and projections 53. Projections 50 extend through slots 52 in a major surface 54 of side members 46 of inner housing 14 and at least partially through slots 56 in outer housing 12. Projections 53 engage apertures 55 on major surface 54 of side members 46 of inner housing 14.

Figure 3:
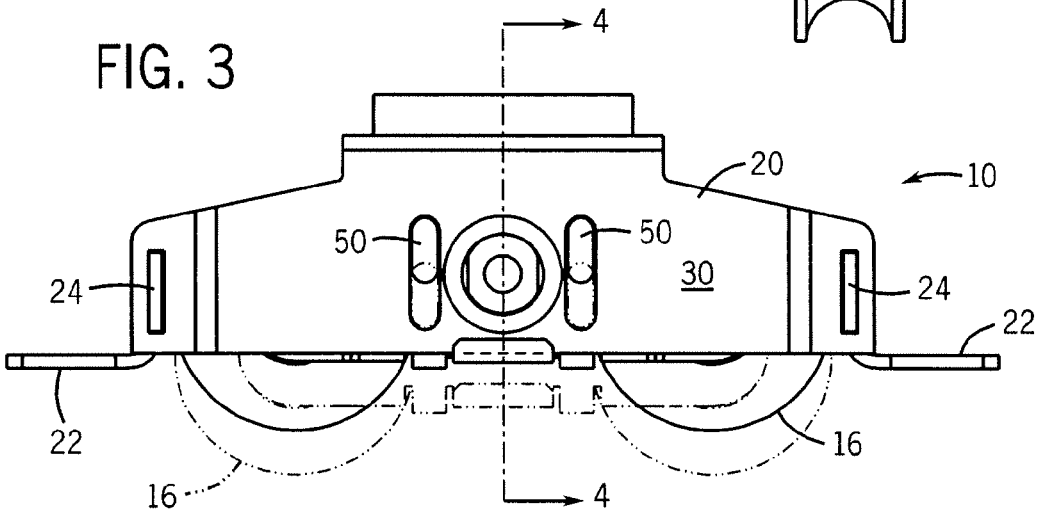
FIG. 3 is a side elevation view of the door roller system of FIG. 1.
Figure 2:
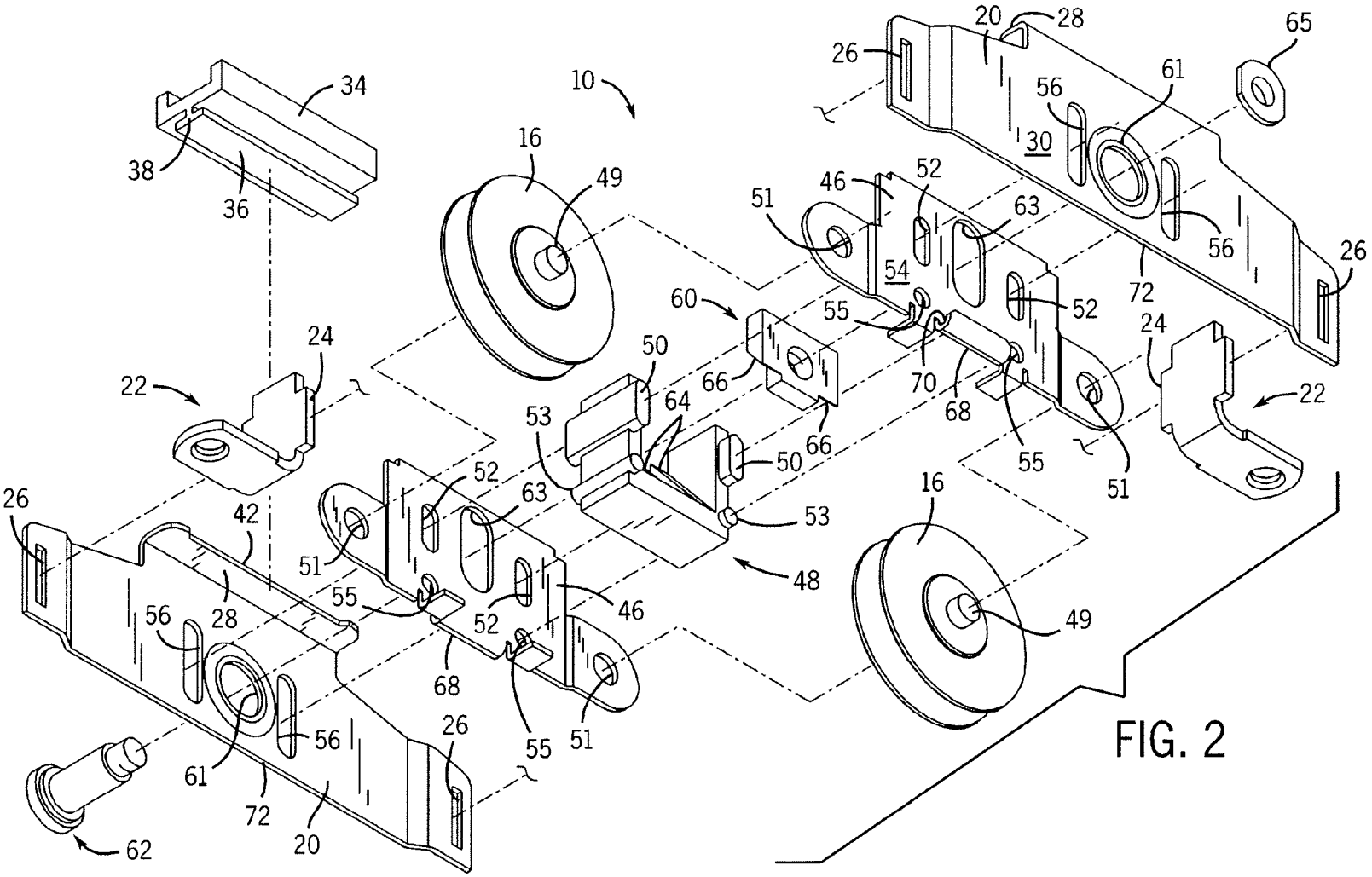
FIG. 2 is an exploded view of the door roller system of FIG. 1.

Base 48 of inner housing 14 includes elements that engage outer housing 12 so that inner housing 14 is maintained in alignment with outer housing 12. These elements are shown as elongated projections 50 that extend generally perpendicular from base 48. Projections 50 are configured to at least partially extend through slots 56 throughout the range of movement of inner housing 14 relative to the outer housing 12. The sliding engagement between projections 50 and slots 56 provides for limited guided movement of inner housing 12, and therefore rollers 16, relative to the outer housing. According to a preferred embodiment, projections 50 and slots 56 are configured to allow generally vertical translational movement of inner housing 14 within outer housing 12 between a first position and a second position, and to inhibit inner housing 14 from rotating or rocking relative to outer housing 12. The elongated guide slots in the various embodiments illustrated in FIGS. 1, 6, and 10 are shown as linear vertical slots having one end adjacent to a top portion of the outer housing (FIGS. 5 and 7-9), or as having the ends of the slots spaced down from the top portion of the outer housing, for example, centrally located on the side members (FIGS. 1, 6, and 10). According to alternative embodiments, the projections and elongated guide slots may have any of a variety of shapes (e.g., rectangular, circular, elongated, oval, elliptical, etc.), sizes, configurations, angular orientations, curvature, or the like. Referring to FIGS. 1 and 3, projections 50 and slots 56 are generally centrally located between the top and the bottom of inner and outer housings 12, 14, i.e., spaced apart from the top portion of outer housing 12 so that the upper edge of inner housing 14 does not contact the upper edge of the outer housing 12.

Rollers 16 are mounted on, and are generally surrounded by, inner housing 14. According to a preferred embodiment, rollers 16 include a groove or recess about its circumference to engage a track. Rollers 16 rotate about projections 49 that act as an axel to engage apertures 51 in side members 46.

Adjustment mechanism 18 is configured to alter the position, such as the height, of outer housing 12 relative to inner housing 14, base 48, and/or wheels 16. Adjustment mechanism 18 includes base 48, a moving element 60, and a control member shown as a fastener 62. Base 48 is coupled to side members 46 of inner housing 14 and includes a pair of inclined surfaces 64. Moving element 60 operates as a wedge and includes a pair of inclined surfaces 66 that slidably engage inclined surfaces 64 on base 48. Fastener 62 is inserted through apertures 61 in side members 20 of outer housing 12 and apertures 63 in the walls of inner housing 14 and threadably engages moving element 60 and a nut 65. Adjustment of the control members (i.e., rotating of fastener 62) provides translational movement of moving element 60, which causes inclined surfaces 66 of moving element 60 to slide along inclined surfaces 64 of base 48. The translational movement of moving element 60 is generally parallel with the axes of rollers 16. Translational movement of moving element 60 causes translational movement of inner housing 14 relative to outer housing 12. The translational movement of inner housing 14 is normal, or perpendicular to the movement of moving element 60 and to the axes of rollers 16.

In addition to engagement between projection 50 and ends of slot 56, movement of inner housing 14 relative to outer housing 12 may also be limited by a tab 68 (e.g., member, flange, clip, projection, etc.). Tab 68 extends from the lower portion of each of side members 46 of inner housing 14. According to an exemplary embodiment, tab 68 curves upwardly so that a recess 70 is formed between tab 68 and side members 46. Along with the tab/slot engagement, tab 68 is configured to act as a stopper to inhibit or prevent further movement of inner housing 14 into outer housing 12 by engaging a lower edge 72 of outer housing 12. Tab 68 is also designed to inhibit or prevent the outside plates or members from spreading apart under excessive loading. According to alternative embodiments, the tab may have any of a variety of shapes and configurations designed to engage a portion of the outer housing.

Figure 5:
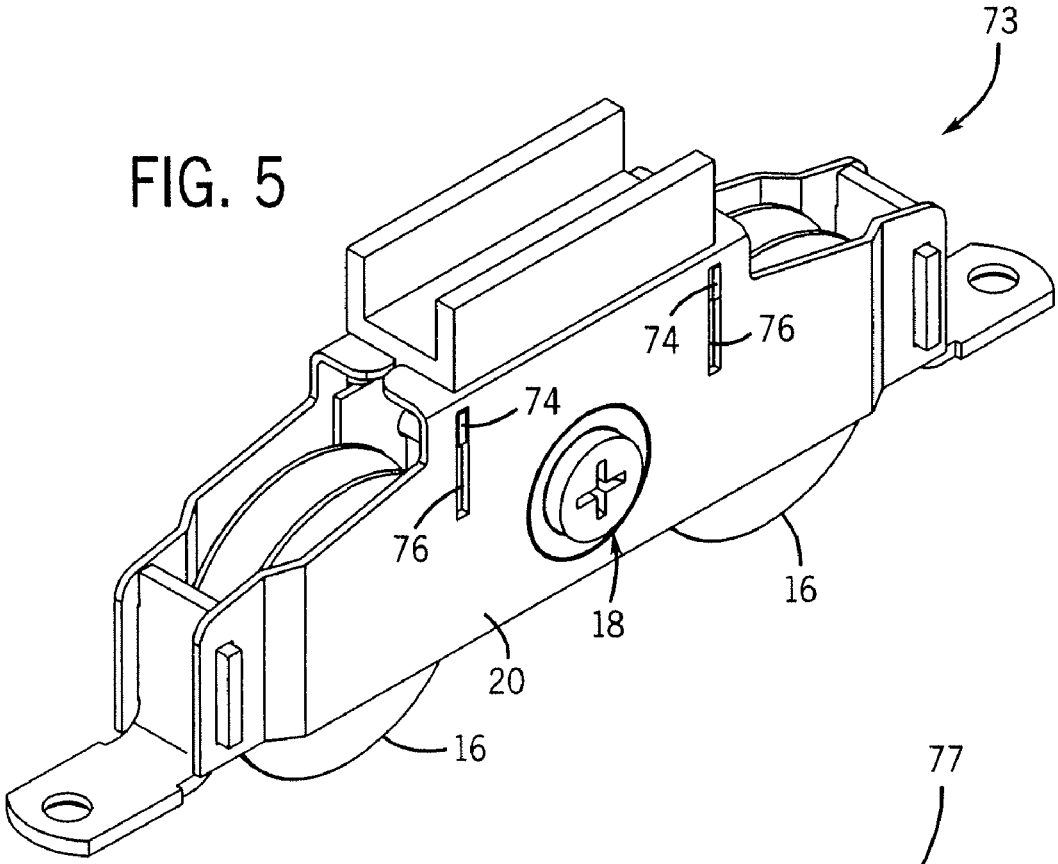
FIG. 5 is a perspective view of a door roller system according to an exemplary embodiment.
Figure 6:
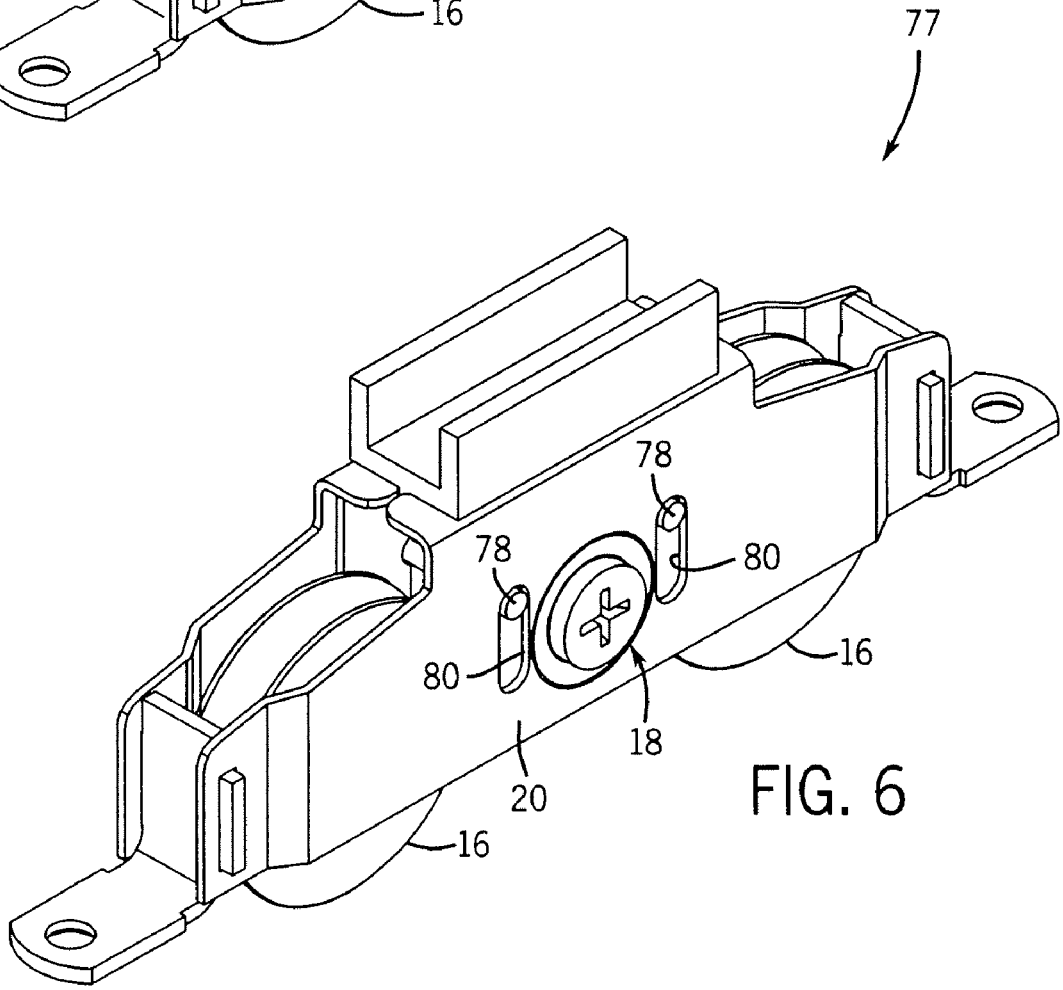
FIG. 6 is a perspective view of a door roller system according to yet another exemplary embodiment.

A door roller system 73 according to an alternative embodiment is shown in FIG. 5. Door roller system 73 includes projections 74 and slots 76. Projections 74 and slots 76 are located at the top portion of outer and inner housings 12, 14. Projections 74 and slots 76 are generally rectangular and thinner than projections 50 and slots 56 shown in FIGS. 1-4.

A door roller system 77 according to an alternative embodiment is shown in FIG. 6. Door roller system 77 includes projections 78 extending from the adjusting base (similar to base 48 in FIG. 2) and slots 80 in the outside housings 12. Projections 78 and slots 80 are generally centrally located between the top and the bottom of inner and outer housings 14, 12, i.e., spaced apart from the top portion of outer housing 12. Projections 78 are generally circular projections emanating from the internal base 48.

Figure 7:
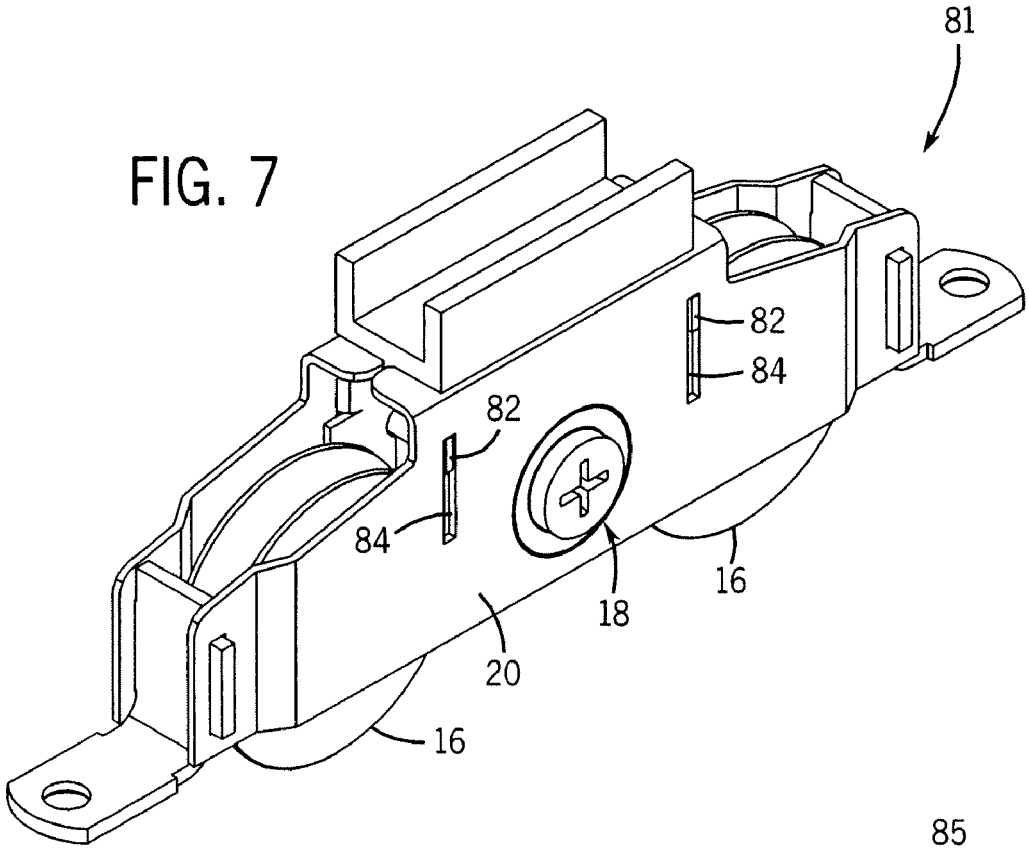
FIG. 7 is a perspective view of a door roller system according to yet another exemplary embodiment.

A door roller system 81 according to an alternative embodiment is shown in FIG. 7. Door roller system 81 includes projections 82 and slots 84. Projections 82 and slots 84 are similar to those shown in FIG. 5, but are spaced apart from the top of inner and outer housings 14, 12.

Figure 8:
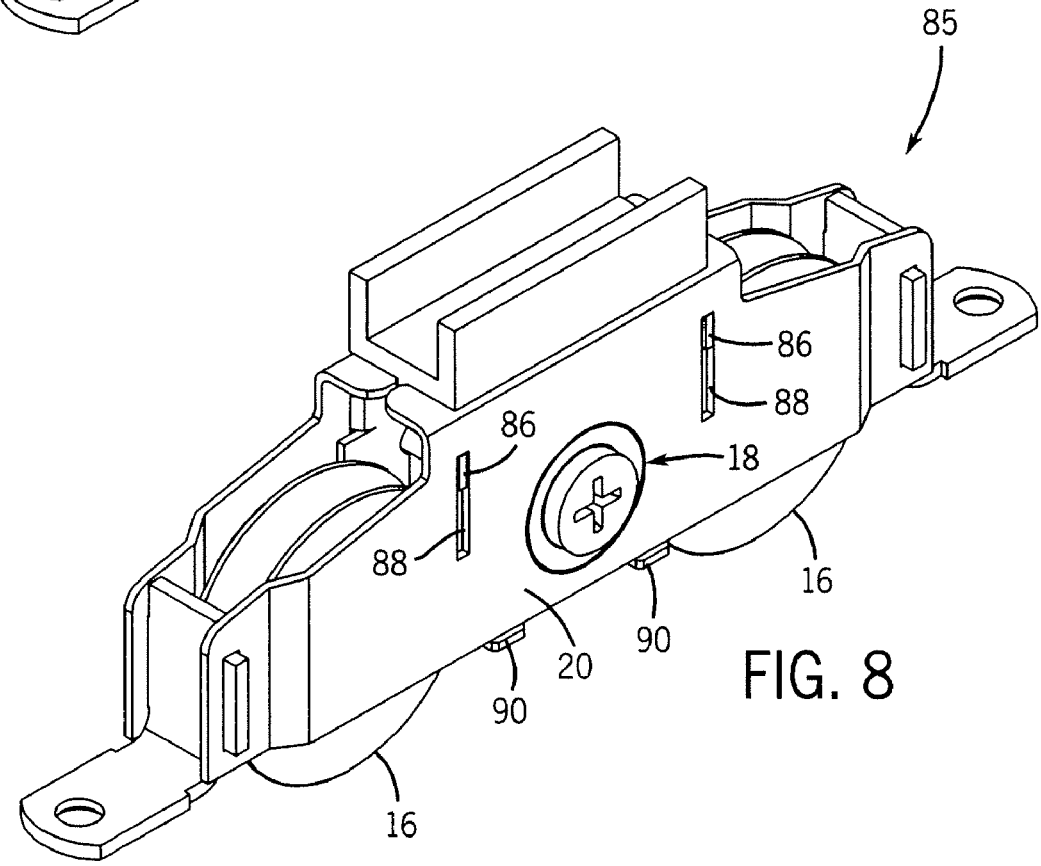
FIG. 8 is a perspective view of a door roller system according to yet another exemplary embodiment.

A door roller system 85 according to an alternative embodiment is shown in FIGS. 8 and 9. Door roller system 85 includes projections 86 and slots 88. Projections 86 and slots 88 are similar to those shown in FIG. 7. The inner housing of door roller system 85 includes a tab 90 (e.g., flange, projection, clips, etc.) that extends from the lower portion of each of the side members of the inner housing. Tabs 90 are configured to engage a lower edge 92 of outer housing 12 to inhibit or prevent further movement of inner housing 14 into or within outer housing 12. Tabs 90 may be generally "L"-shaped and extend outwardly generally perpendicularly from side members 46 of the inner housing 14 as shown in FIG. 8. Alternatively, tabs 90 may be generally "U"-shaped and curve upwardly to form a recess along with outer surfaces of side members 46. The four "U" shaped tabs extend from the bottom of the inner housing such that the lower portion of the side member 20 fits within a recess of the U-shaped tabs. This engagement is designed to inhibit or prohibit the lower edge of the walls of the outer housing from extending outwardly as excessive loads are applied to the outer housing.

A door roller system 93 according to an alternative embodiment is shown in FIG. 10. Door roller system 93 includes projections 94 and slots 96. Projections 94 and slots 96 are similarly shaped and located as shown in the embodiment shown in FIGS. 1-4, but inner housing 14 does not include flanges extending from inner housing 14 to engage outer housing 12.

Figure 11:
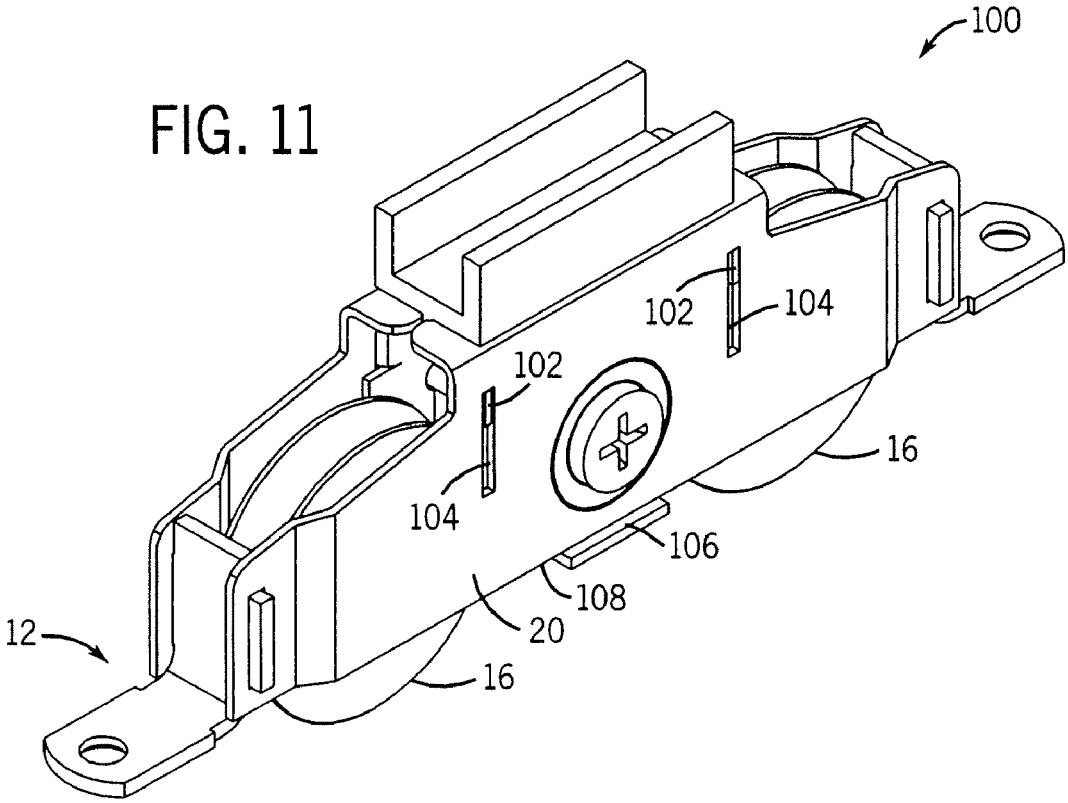
FIG. 11 is a perspective view of a door roller system according to another exemplary embodiment.

A door roller system 100 according to an alternative embodiment is shown in FIG. 11. Door roller system 100 includes projections 102 and slots 104. Projections 102 and slots 104 are similarly shaped and located as shown in the embodiment shown in FIG. 7. The inner housing of door roller system 100 includes a tab 106 (e.g., flange, projection, clips, etc.) that extends from the lower portion of each of the side members 20 of the inner housing 12. Tabs 106 are configured to engage a lower edge 108 of outer housing 12 to inhibit or prevent further movement of inner housing 14 into or within outer housing 12. Tabs 106 extend outwardly generally perpendicularly from side members 46 of the inner housing 14.

The particular materials used to construct the preferred and exemplary embodiments are illustrative. For example, stamped steel or stainless steel is the preferred method and material for making the side members. Machined steel or stainless steel is the preferred method and material for making the rollers or adjusting wedge fasteners or axles. Injection molded thermoplastic is the preferred method and material for making the base. Components of the housings, wedge, or rollers can also be manufactured from other materials and methods such as stamped alloy materials such as steel, stainless steal, extruded aluminum, or any of a variety of thermoplastic resins such as polypropylene, high density polyethylene, other polyethylenes, acrylonitrile butadiene styrene ("ABS"), polyurethane nylon, any of a variety of homopolymer plastics, copolymer plastics, plastics with special additives, filled plastics, etc. Also, other molding operations may be used to form these components.

It is also important to note that the construction and arrangement of the elements of the door roller system as shown in the preferred and other exemplary embodiments are illustrative only. Although only a few embodiments of the present invention have been described in detail in this disclosure, those skilled in the art who review this disclosure will readily appreciate that many modifications are possible (e.g., variations in sizes, dimensions, structures, shapes and proportions of the various elements, values of parameters, mounting arrangements, materials, colors, orientations, etc.) without materially departing from the novel teachings and advantages of the subject matter recited in the claims. For example, the projections or tabs that slide within the slots on the outer housing may be a variety of shapes (e.g., square, rectangular, circular, oval, elongated, etc.) and sizes. Accordingly, all such modifications are intended to be included within the scope of the present invention as defined in the appended claims. The phraseology and terminology employed herein is for the purpose of description and should not be regarded as limiting. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and/or omissions may be made in the design, operating conditions and arrangement of the preferred and other exemplary embodiments without departing from the spirit of the present invention as expressed in the appended claims.

What is claimed is:

1. A door roller system comprising:

a first housing including at least one vertical side member having at least two vertical slots;

a base slidably coupled to the first housing and having at least two projections that each extend at least partially through the vertical slots in the vertical side member of the first housing;

at least one wheel coupled to the base;

wherein the projections on the base are configured to slide within the vertical slots on the first housing throughout movement of the base relative to the first housing;

an adjustment mechanism comprising a control member oriented substantially perpendicular to the side member, the adjustment mechanism configured to move the first housing relative to the wheel, the adjustment mechanism including a fastener being located between the at least two vertical slots in the first housing, the fastener moving within the base in a vertical direction spaced from and parallel to the at least two vertical slots in the first housing; and a second housing including the base and two U-shaped tabs extending from a lower portion of the second housing, wherein each tab extends from an opposite side of the second housing and is engageable with a lower edge of the first housing to limit the movement of the base relative to the first housing.

2. The system of claim 1, wherein one end of each slot is adjacent to a top portion of the first housing.

3. The system of claim 1, wherein each slot is spaced apart from a top portion of the first housing.

4. The system of claim 1, wherein each slot is elongated and comprises a first end and a second end so that the projection of the base can slide between the first end and the second end.

5. The system of claim 4, wherein the first housing includes an upper edge, the lower edge, a first end and a second end, one of the at least two vertical slots extending between the upper edge and lower edge and being located closer to the first end then the other of the vertical slots, the other of the vertical slots extending between the upper edge and lower edge and being located closer to the second end than the one of the vertical slots, wherein each projection remains in each respective slot as the base is moved relative to the first housing.

6. The system of claim 1, wherein each projection is an elongated member.

7. The system of claim 1, wherein the at least one vertical side member comprises a pair of spaced apart side members, and each slot comprises a pair of slots on each of the side members.

8. The system of claim 1, wherein the adjustment mechanism further comprises the base, and a wedge.

9. The system of claim 8, wherein the base includes an inclined surface and the wedge includes an inclined surface that engages and slides along the inclined surface of the base to transfer operation of the control member to vertical movement of the first housing relative to the wheel.

10. A door roller system comprising:

an outer housing having a pair of vertical side members;

an inner housing movable relative to the outer housing between a first position and a second position, the inner housing having two tabs extending from opposite sides of a lower portion of the inner housing and outward from the inner housing towards the vertical side members of the outer housing, the tabs extending from the inner housing in a direction perpendicular to the vertical side members;

wherein the tabs contact a bottom edge of the outer housing when the inner housing is in the second position; and an adjustment mechanism comprising a control member transverse to the side member, the adjustment mechanism configured to move the outer housing relative to the wheel.

11. The system of claim 10, wherein each tab is generally U-shaped and includes a recess that receives the bottom edge of the outer housing when the inner housing is in the second position, and wherein the U-shaped tabs are configured to prevent the outer housing from spreading apart.

12. The system of claim 10, wherein each tab comprises a flange extending outwardly from the inner housing and configured to engage the outer housing to limit vertical movement of the inner housing relative to the outer housing.

13. The system of claim 10, wherein the outer housing comprises at least two vertical slots and the inner housing comprises at least two projections configured to slide within each respective slot on the outer housing.

14. A door roller system comprising:

a first housing having at least two vertical slots;

a second housing slidably coupled to the first housing and including a pair of vertical side members and a base having at least two projections;

at least one wheel rotatably coupled to the second housing; and wherein the projections extend through the slots in the first housing and are configured to slide within the slots throughout the range of movement of the second housing between a first position and a second position, and wherein the projections and slots are configured to at least partially inhibit the first housing from rocking relative to the second housing, an adjustment mechanism comprising a control member transverse to the side members, the adjustment mechanism configured to move the first housing relative to the second housing; wherein the control member includes a fastener located between the at least two slots, the fastener moving relative to the inner housing in a vertical direction spaced from and parallel to the at least two slots; and two U-shaped tabs extending from a lower portion of the second housing, each tab extending from a different one of the pair of vertical side members of the second housing, wherein each tab is engageable with a lower edge of the first housing to limit the movement of the first housing relative to the second housing.

15. The system of claim 14, wherein the projection sliding within each slot is configured to allow limited guided movement.

16. The system of claim 14, wherein the limited guided movement comprises vertical translating movement.

* * * * *